United States Patent [19]

Williams

[11] Patent Number: 4,640,461

[45] **Date of Patent: * Feb. 3, 1987**

[54] FOAM-APPLYING NOZZLE

[75] Inventor: Leslie P. Williams, Port Neches, Tex.

[73] Assignee: Cause Consequence Analysis, Inc., Port Neches, Tex.

[ * ] Notice: The portion of the term of this patent subsequent to Feb. 5, 2002 has been disclaimed.

[21] Appl. No.: 762,019

[22] Filed: Aug. 1, 1985

Related U.S. Application Data

[63] Continuation of Ser. No. 399,112, Jul. 16, 1982, abandoned.

[51] Int. Cl.[4] ..... B05B 7/26; B05B 7/30; B05B 7/06; A62C 35/00

[52] U.S. Cl. ..... 239/317; 239/318; 239/427.3; 239/432; 239/458; 169/15

[58] Field of Search ..... 239/310, 317, 318, 432, 239/427, 427.3, 456, 457, 458; 169/14, 15

[56] References Cited

U.S. PATENT DOCUMENTS

| | | | |
|---|---|---|---|
| Re. 25,037 | 9/1961 | Brazier | 169/14 X |
| Re. 29,717 | 8/1978 | Thompson . | |
| 2,198,998 | 4/1940 | Housberger | 239/318 |
| 2,991,016 | 7/1961 | Allenbaugh, Jr. | 239/456 |
| 3,338,173 | 8/1967 | Gunzel, Jr. et al. . | |
| 3,548,949 | 12/1970 | Williams et al. | 169/1 |
| 3,562,156 | 2/1971 | Francen | 252/8.05 |
| 3,578,590 | 5/1971 | Niekeker et al. | 252/8.05 |
| 3,749,318 | 7/1973 | Cottell | 239/432 |
| 3,772,195 | 11/1973 | Francen | 252/8.05 |
| 3,784,113 | 1/1974 | Specht . | |
| 4,277,030 | 7/1981 | Hechler, IV . | |
| 4,497,442 | 2/1985 | Williams | 239/437 |

FOREIGN PATENT DOCUMENTS

| | | | |
|---|---|---|---|
| 2638000 | 8/1976 | Fed. Rep. of Germany . | |
| 1062071 | 4/1954 | France | 169/15 |
| 591697 | 8/1947 | United Kingdom | 169/15 |

OTHER PUBLICATIONS

Elkhart Brass Manufacturing Co., Inc. catalog No. S on Fire Fighting Equipment, pp. 2–18, 22–29.

*Primary Examiner*—Joseph F. Peters, Jr.
*Assistant Examiner*—Patrick N. Burkhart
*Attorney, Agent, or Firm*—Pravel, Gambrell, Hewitt & Kimball

[57] ABSTRACT

A foam-applying nozzle assembly (N) for applying a foam made up from a supply of a foam-forming liquid composition (F) and a flowing liquid stream (W) includes an inner barrel (I) having an axial bore (10) for communicating the liquid stream (W) from a hose. Eductor means (E) with the inner barrel (I) extracts the foam-forming liquid composition (F) from the supply of the foam-forming composition. The eductor means (E) inducts the extracted foam-forming liquid composition (F) into a portion (W') of the liquid stream (W) flowing through the eductor means (E). The eductor (E) has a discharge opening (**22*o*) in proximity to the outlet of the inner barrel I for mixing the foam-forming composition (F) with the liquid stream (W) from the inner barrel (I) in proximity to the discharge of the liquid stream, whereby a foam is created. Flow regulating nozzle means (R) mounted in an outlet (10*o*) of the bore (10**) regulates the lateral extent of the discharged stream (W).

8 Claims, 5 Drawing Figures

FOAM-APPLYING NOZZLE

This is a continuation of co-pending application Ser. No. 399,112 filed on July 16, 1982, now abandoned.

BACKGROUND OF THE INVENTION

1. Field of the Invention

This invention relates to the field of foam-forming equipment, and more particularly to nozzles for the application of a foam from a foam concentrate mixed with a liquid.

2. Description of the Prior Art

Fire-fighting nozzles for the application of a water stream or a water fog on a fire have been known for some time. Such nozzles are attached to a fire hose carrying a liquid stream, such as water, and frequently are adjustable to apply the fire-extinguishing liquid in a pattern ranging from a fog-like application to a straight stream, an example of which is made by Elkhart Brass Manufacturing Co., Inc. of Elkhart, Ind. However, an application of water is not desirable for all types of fires.

Fire-extinguishing foam-forming liquid compositions have been utilized in the extinguishing of certain types or classes of fires. Many of these foam-forming compositions will, when mixed with water and aerated with large quantities of air, form relatively stable foams, particularly for the extinguishing of large fires. Such liquid foam concentrates are known under the trade names of AFFF of Minnesota Mining and Manufacturing Company, Minnesota and Emulsiflame of Elkhart Brass Manufacturing Co., Inc. Other such foams are generally described in U.S. Pat. Nos. 3,772,195; 3,562,156; 3,578,590; and 3,548,949.

The foam-forming liquid compound has been generally supplied as a concentrate which was inducted into the flowing liquid stream by an in-line or by-pass foam eductor. The separate eductor was connected between the nozzle and the liquid stream pump or source. The foam concentrate was withdrawn by the eductor or pumped from the concentrate storage and was then diluted and/or mixed with the liquid stream in the desired concentration. Thereafter, the foam-forming concentrate and liquid mix was aerated in a separate system, forming the foam which discharged from a nozzle.

Generally, the foam applying nozzle used with the separate eductor has been of the same type utilized to apply water. Some water nozzles have had the stem-portion modified (the stem limits and assists in directing the water flow) for the application of the foam. These are non-aspirating peripheral jet nozzles. Additionally, aeration foam tubes are fitted on existing handline nozzles for additional air, which forms a thicker foam blanket.

Using such prior art concept and equipment, wherein the foam was first separately generated and then the foam was discharged through a nozzle, the distance the foam could be projected from the nozzle has been considerably shorter than the distance water alone could be projected through the nozzle. For example, with foam, the maximum distance was usually only about 170 feet whereas with water it was about 300 feet. The separate foam eductor limits the flow (gallonage per minute) and the line pressure to the nozzle. Typically, foam eductors handled between 30 and 250 gallons per minute; whereas, nozzles handled in excess of 1000 gallons per minute. The separate eductor constricted the complete flow of water creating a pressure drop of 30–40% across the eductor. This loss of pressure was created by the flow into the eductor working against backpressure due to the constriction. Thus, the previous separate foam eductor and nozzle limited the flow and range capabilities of the nozzle and required the firefighter to approach the fire more closely.

The discharge distance of foam has previously been increased using a balanced pressure proportioning system. This system included a pump, control valve and orifice which introduced the foam concentrate under pressure into the hose behind the nozzle. Since this system was pressurized, the drop in pressure created by the separate eductor was eliminated, which allowed the full flow pressure to form at the nozzle. The balanced pressure proportioning system was rather cumbersome, required a power source for the pump, and was more expensive than the separate eductor and nozzle system. The present invention discharges the foam generally the same distance as the balanced pressure proportioning system, while eliminating the additional equipment, such as the pump, control valve and orifice.

SUMMARY OF THE INVENTION

The present invention relates to a new and improved nozzle for applying a foam made up from a foam-forming liquid composition and a flowing liquid stream such as water. An inner barrel having an inlet and outlet communicates the liquid stream from a hose. Eductor means with the inner barrel extracts the foam-forming liquid composition from a supply of the concentrate and inducts the foam-forming liquid composition into a portion of the liquid stream flowing through the nozzle. The foam concentrate-liquid mixture is aerated and applied in the desired pattern. A flow regulating nozzle means is mounted in the outlet of the inner barrel and regulates the lateral extent of the stream discharged.

The present nozzle for applying a foam uses approximately 7 gallons per minute (gpm) flow of the liquid stream to create the reduced pressure for inducting the foam-forming liquid concentrate. The pressure drop attributable to the 7 gpm flow during the induction of the foam is insignificant compared to the 30–40% reduction in pressure with the prior separate eductor and nozzle combinations. Additionally the foam concentrate-liquid mixture is added to the remaining portion of the liquid stream at an area of reduced pressure compared to the pressure in the interior of the nozzle, which enhances the withdrawal of the foam concentrate from the supply. The discharge of the foam concentrate-liquid mixture permits the substantially full discharge of the main portion of the liquid stream flowing through the nozzle without appreciably decreasing the distance of the discharge by a reduction in pressure.

DESCRIPTION OF THE PREFERRED EMBODIMENT

Figure 1:
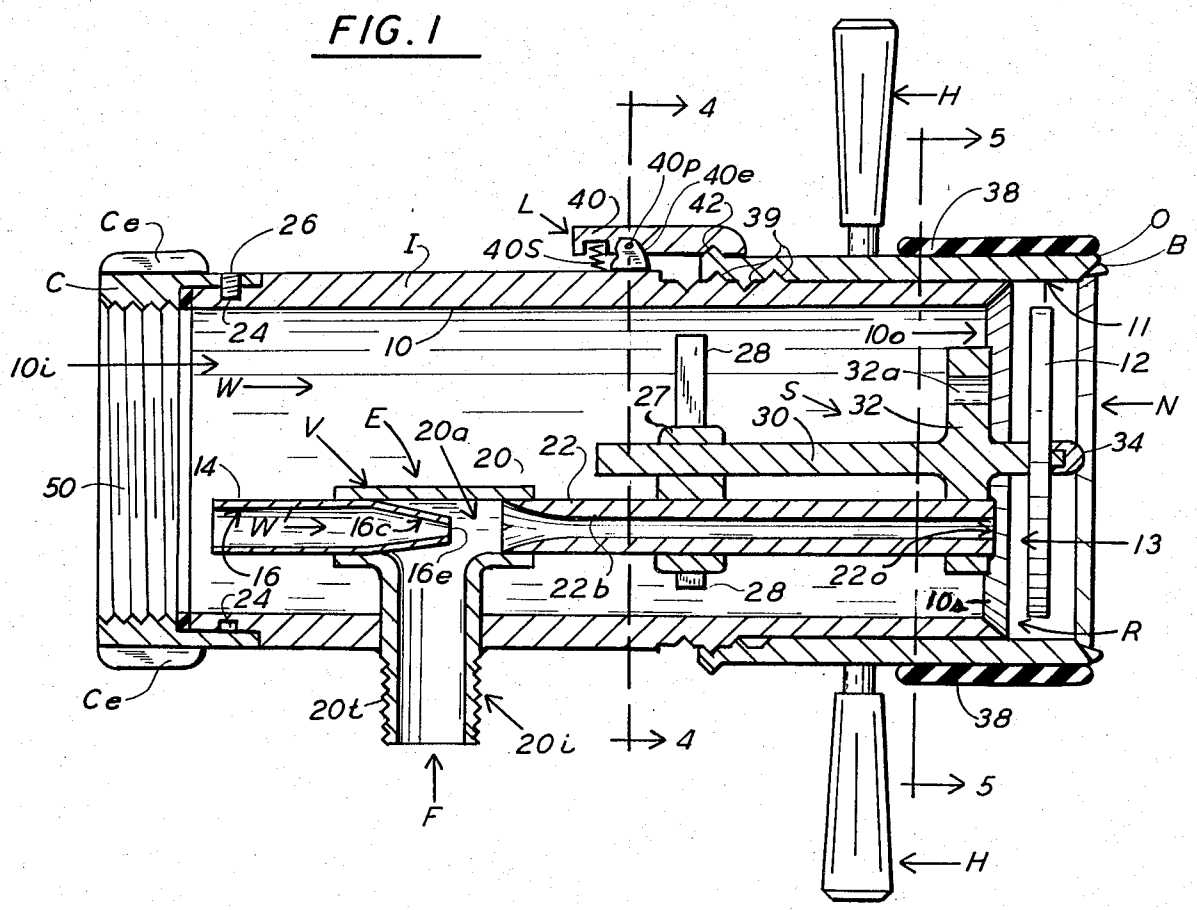
FIG. 1 is a cross-sectional view of the invention with the eductor off-center.

In the drawings, the letter N refers generally to the nozzle of this invention which is adapted for applying a foam, such as the type for fire-extinguishing, made up from a foam-forming liquid composition F and a flowing liquid stream W. Briefly, the nozzle N includes an inner barrel I having an axial bore 10 with inlet 10*i* and outlet 10*o* for communicating the liquid stream W from a hose, monitor or other source (not shown) and having further a flow regulating nozzle means R mounted in the outlet 10*o* for regulating the lateral extent of the stream W discharged from the inner barrel I, so that the discharged fluid stream may be varied from a relatively compact small diameter stream to a wider larger diameter fog-like spray. Eductor means E with the inner barrel I extracts the foam-forming fire-fighting liquid composition F from a supply of the foam-forming composition F. The eductor means E inducts the foam-forming liquid composition F into a portion W' of the liquid stream W flowing through the inner barrel I. A mixing plate 12 and a spaced-apart deflection plate 32 form a mixing passage 13 therebetween for receiving the foam-forming composition diluted in the liquid stream portion W'. The mixing plate 12 is mounted with the inner barrel I substantially perpendicular to the flow of the liquid stream W to assist in aerating and directing the foam-forming liquid which has been inducted into the liquid stream portion W' as the foam concentrate/-liquid mixture impacts the mixing plate 12, forming the foam. Deflection plate 32 directs the liquid stream W from the outlet 10*o* of inner barrel I. An outer sleeve O is generally movably mounted with the inner barrel I for directing or focusing the liquid stream in the desired form of application. Coupling C of conventional construction has internal threads 50 for threaded engagement with a typical hose coupling on a fire hose (not shown), so as to direct the liquid stream W from the hose through the nozzle N.

Referring now more particularly to FIG. 1, the eductor means E is generally a venturi-type tube V mounted within the axial bore 10 of inner barrel I and axially aligned with the flow of the liquid stream being generally in the direction of the arrow shown in FIG. 1. As the liquid stream W flows into the inlet 10*i* of the bore 10 of the inner barrel I from the hoses or source, a portion W' of the stream W flows into a tubular constricting member 14 having an axial bore 16. The axial bore 16 has a constricting portion 16*c* with a decreasing diameter ending with an orifice 16*e* of smaller diameter than the axial bore 16. The stream portion W' exits from the member 14 at exit or orifice 16*e* and enters the interior cavity 20*a* of T-shaped expansion vacuum body 20. The interior cavity 18 is larger dimensionally than the orifice 16*e* and constricting section 16*c* of member 14 causing the flow of stream portion W' to expand in cavity 20*a* and thereby decrease the flow rate of the liquid stream portion W' flowing through the cavity 20*a*. This slowing of the flow rate in cavity 20*a* after exiting from orifice 16*e* creates a reduced pressure in the cavity 20*a* due to a venturi effect. Preferably the body 20 forms a T-joint with lower inlet portion 20*i* extending through the inner barrel I. The exposed end of inlet portion 20*i* has threads 20*t* for receiving a hose or tubular means T with coupling Tc (FIG. 2) for communicating the foam-forming liquid concentrate F from a separate supply of the foam concentrate, such as a drum or canister (not shown). The reduced pressure created by the venturi effect in the body 20, transmitted through tubular means T, causes the foam concentrate F to flow from its supply so as to induct the concentrate F into the stream portion W' in cavity 20*a*. Tubular exit member 22 mounted with one arm of the body 20 preferably has an axial bore 22*b* substantially axially aligned with the flow of the liquid stream W. Exit member 22 has discharge opening or outlet 22*o* disposed in proximity to the mixing plate 12 and the outlet 10*o* of the inner barrel I, whereby the foam-forming liquid composition which was inducted into the stream portion W' impacts upon the mixing plate 12. The outlet 22*o* of exit member 22 is spaced apart from mixing plate 12 to allow the impacted mixture to flow radially from the exit member 22 and mixes the foam-forming composition with the liquid stream W from the inner barrel I in proximity to the discharge of the liquid stream W.

Inner barrel I is generally a metallic tubular segment. Annular groove 24 at the exterior base of inner barrel I coacts with set screw 26 mounted in coupling C to rotatably mount and secure coupling C to the base of inner barrel I when set screw 26 extends into groove 24. Ears Ce formed with the exterior of coupling C assist in threading the coupling C on a hose.

Figure 4:
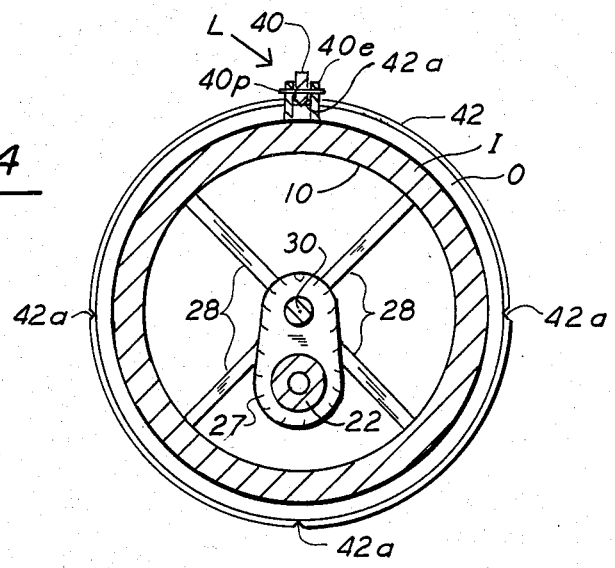
FIG. 4 is a cross-sectional view of the invention along line 4—4 of FIG. 1.
Figure 5:
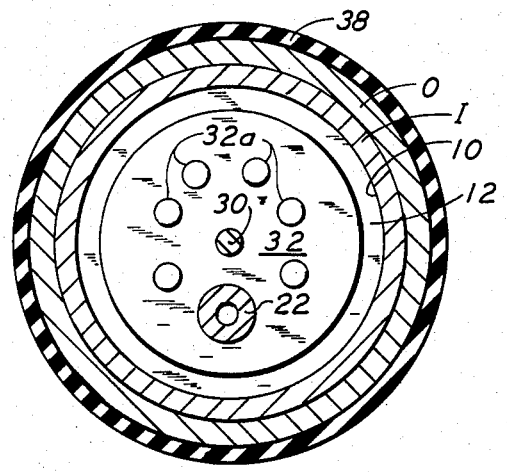
FIG. 5 is a cross-sectional view of the present invention taken along line 5—5 of FIG. 1.

Referring now to FIG. 4, braces 28 extend from the interior wall of axial bore 10 of the barrel I, and they support a rod 30, deflection plate 32 and mixing plate 12 forming stem S in outlet 10*a*. Support member 27 extends between exit member 22 and rod 30 with braces 28 to support exit member 22. Deflection plate 32 is mounted to the exterior end of rod 30 adjacent and spaced apart from mixing plate 12. Mixing plate 12 is affixed outwardly of deflection plate 32 to the exterior end of rod 30 by threaded nut 34. It is preferred that mixing plate 12 be dimensionally larger than deflection plate 32. Mixing passage 13 is formed between deflection plate 32 and mixing plate 12 for receiving the foam concentrate/liquid mixture discharged from outlet 22*o*. Openings 32*a* are formed in deflection plate 32 for passing a portion of the liquid stream W through deflection plate 32 into mixing passage 13 (FIG. 5).

The flow regulating nozzle means R includes stem S and an outer sleeve or barrel O, being a metallic tubular member having an axial bore 11 and rotatably mounted with threads 39 to inner barrel I. As outer sleeve O is rotated or moved relative to the inner barrel I, the outer barrel O moves longitudinally relative to inner barrel I, thereby increasing the overall length of nozzle N. The rotation of outer sleeve O controllably selects the type of application, which ranges between positions creating a fog-like foam application and a position forming a straight-stream foam application. FIG. 1 shows the outer barrel O in the extended position for a compact, relatively small diameter stream-like application approaching the diameter of the bore 10 and FIG. 3 shows the outer barrel O in the retracted fog-like application position wherein the discharged stream is laterally deflected outwardly to some extent to provide a larger diameter discharged spray.

Preferably diffusing teeth B are mounted with channels formed therebetween on the exterior end O' of the outer sleeve O and project therefrom in an evenly spaced distribution for improving the fog-like application. Composite or rubber annular ring 38 is adjacent and concentric to the exterior surface of outer sleeve O and provides cushioning to protect the exterior of outer barrel O from damage. At least one handle H preferably extends from outer sleeve O to assist in rotating outer sleeve O. Alternatively, the handle H extends from the inner barrel I.

Locking means L retains outer sleeve O in the selected mode of application. Articulated beam 40 of conventional construction is mounted with inner barrel I by means of ears 40*e* and pivot 40*p* so as to rest in a notch 42*a*, one of which is shown in an annular ring or ridge 42 affixed to the exterior surface of outer sleeve O at its interior end. As outer sleeve O is rotated, beam 40 is raised by the ring 42 until one of a plurality of the notches 42*a* is located directly beneath beam 40. The lowering of beam 40 by spring 40*s* into the notch 42*a* restrains further rotation of outer sleeve O.

Figure 2:
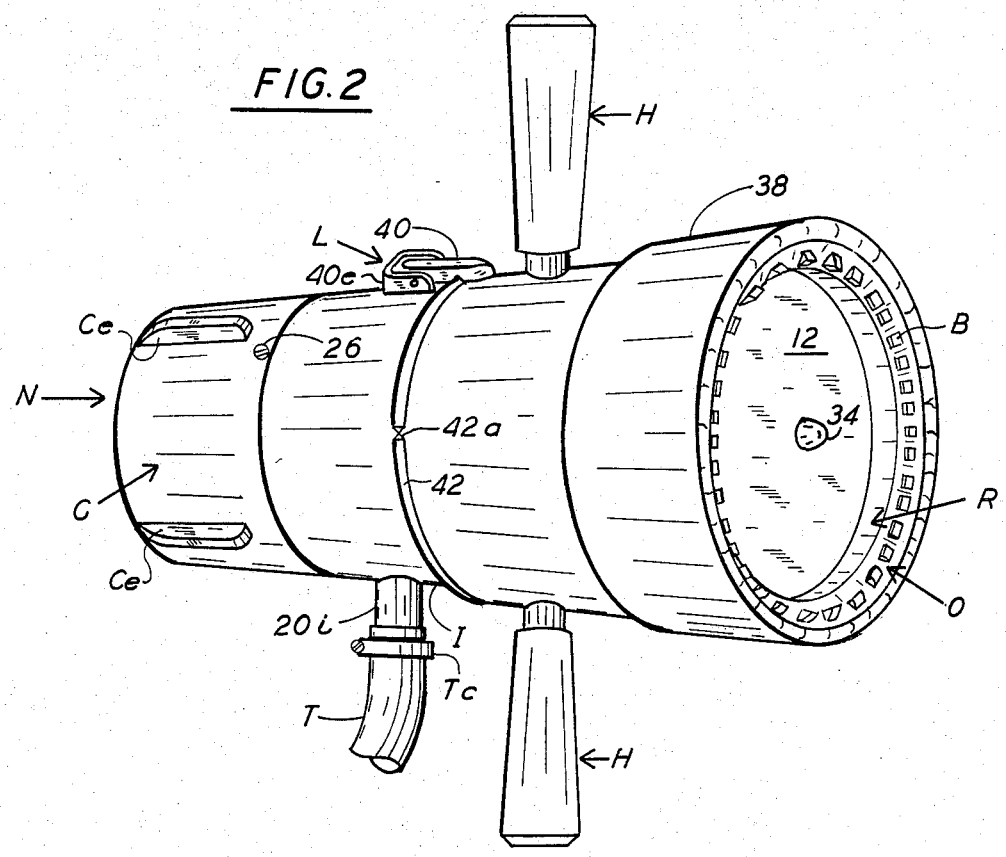
FIG. 2 is a perspective view of the nozzle of the present invention.
Figure 3:
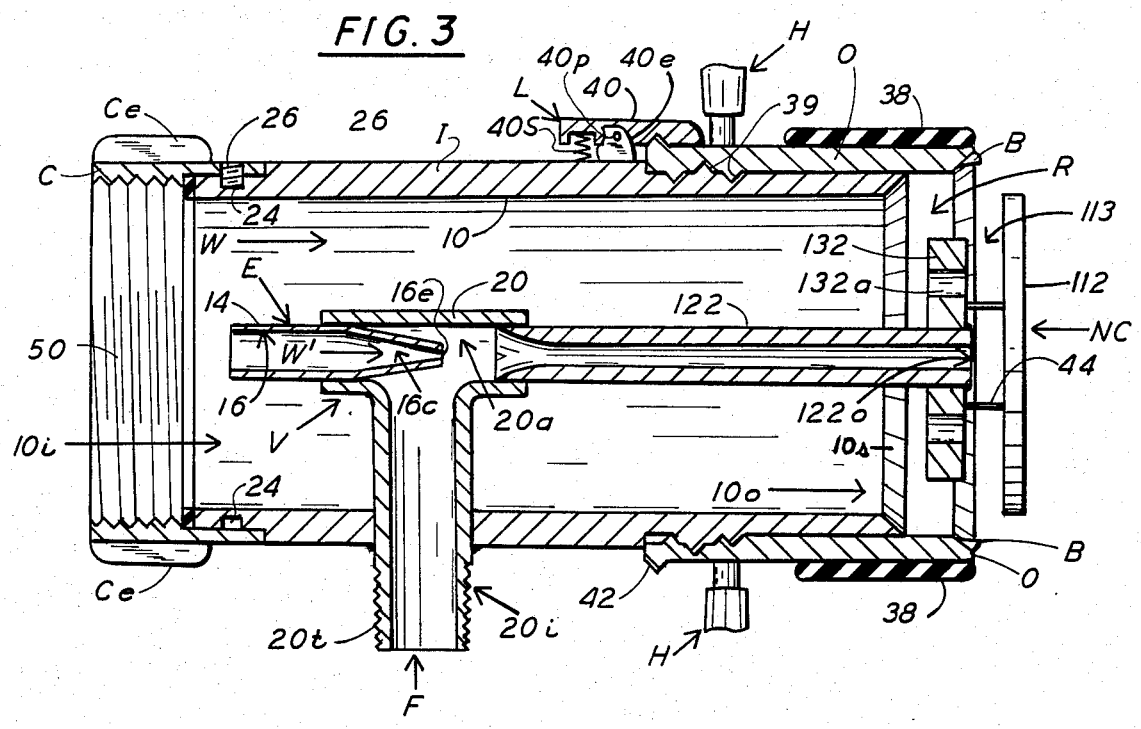
FIG. 3 is a cross-sectional view of the present invention with the eductor along the center line of the nozzle.

FIG. 3 is an alternative embodiment of the present nozzle NC having the eductor means E along the centerline of the device rather than offset from the centerline as in FIG. 2. All of the parts in FIG. 3 bear the same letters and numerals except those that have been modified, and they have the same letters and numerals preceded by the numeral "1". Exit member 122 supports and mounts deflection plate 132 with openings 132*a*. Outlet 122*o* of exit member 122 is exposed to communicate the diluted foam concentrate/liquid mixture to mixing plate 122. Spacing rods 44 extend from deflection plate 132 and mount mixing plate 112 spaced apart and adjacent deflection plate 132 such that the foam concentrate/liquid stream mixture impacts mixing plate 112 in mixing passage 113 from outlet end 122*o* of exit member 122 and is directed radially therefrom.

OPERATION

In the operation of the foam applying nozzle N, nozzle N is affixed to a hose with coupling C. Generally the liquid stream is water pumped from a fire hydrant or fire truck or other suitable pump. Tube T is connected to inlet 20*i* and placed within the supply of foam concentrate F.

As the water W is pumped into nozzle N in the direction of the arrow in FIGS. 1 and 3, a portion W' of the water stream W flows into the bore 16 of member 14. As water W' flows through constricting portion 16*c*, the velocity increases. As the water W' enters cavity 20*a*, the venturi effect from the expanding flow creates a reduced pressure in cavity 20*a* which is communicated through tube T to cause the foam concentrate F to flow from its supply which is generally at atmospheric pressure. The foam concentrate F is introduced into cavity 20*a* generally in the direction of the arrow shown in FIGS. 2 and 3. The foam concentrate F is inducted into the water stream W' in cavity 20*a* and is diluted forming a foam concentrate/water mixture. The mixture exits cavity 20*a* through bore 22*b* of exit member 22. The foam concentrate/water mixture is discharged from outlet end 22*o* of exit member 22 into mixing passage 13 and impacts mixing plate 12. Upon impact the mixture is partially aerated initially forming the foam. Due to the constant flow of the concentrate/water mixture from outlet 22*o*, the mixing plate 12 and spaced apart deflection plate 32 direct the mixture outwardly from exit member 22. At the same time the remaining portion of the water flow is communicated through the bore of nozzle N at a high pressure and impacts upon the interior surface of deflection plate 32. A portion of the water flow passes through openings 32*a* and further mixes with and dilutes the foam concentrate/water mixture in mixing passage 13 between mixing plate 12 and deflection plate 32. The remaining portion of the water stream W is directed radially after impacting against deflection plate 32.

The extension or retraction of outer sleeve O by its rotation changes the pattern of the foam exiting the nozzle N from a foam-like application to a straight-stream application. When the outer sleeve O is fully extended relative to inner barrel I, the radial flow of the water stream W from being deflected by deflection plate 32 and the concentrate/water mixture from mixing passage 13 contacts the interior surface of axial bore 11 and slanted edge 10*s* of the outlet 10*o* of axial bore 10 to focus and direct the flow into a straight stream exiting from the nozzle N between bore 11 and the edges of plates 12 and 32.

When outer sleeve O is fully retracted onto inner barrel I, the radial flow of both the water W deflected by deflection plate 32 in the outlet 10*o* and the foam concentrate/water from mixing passage 32 mixture is obstructed by only a minimum of the interior surface of bore 11 of outer barrel O. As the flow penetrates through teeth B, the teeth B tend to diffuse the flow pattern into improving the fog-like application.

The gallonage of water flow and proportion of foam concentrate to water are variable by adjusting the penetration of the stem S with plates 32 and 12 into the interior bore of the nozzle N. As deflection plate 32 is moved relative to slanted edge 10*s*, the passage for the flow of stream W between edge 10*o* and the edge of disk 32 varies. Moving plate 32 toward the interior of inner barrel I restricts the flow of liquid stream W and raises the proportion of foam concentrate relative to stream W. Similarly, moving plate 32 from the interior of inner barrel I increases the flow of stream W and decreases the relative concentration of foam concentrate.

Mixing passage 13 is substantially at atmospheric pressure, whereas the pressure in the interior bore of nozzle 10 reaches a maximum of about 125 pounds per square inch. The differential in pressure further enhances the reduced pressure in the eductor means E for withdrawing the foam concentrate F from its supply. The comparative reduced pressure in mixing passage 13 also enhances the combining of the foam concentrate/-liquid mixture exiting from mixing passage 13 with the main body of liquid stream W exiting from outlet 10*o*. Since the foam concentrate/liquid mixture is introduced into the area of atmospheric pressure, the present invention has only an insignificant pressure drop through the introduction of the foam concentrate/water mixture compared to the previous combination foam nozzles and separate eductor. Due to the pressure gradient across mixing passage 13, the eductor E is alternatively constructed as above, but without the constricting section 16*c* of member 14. Without constricting section 16*c* the drop in pressure across the stem from the higher interior pressure to atmospheric pressure creates the reduced pressure communicated through bore 22*b* of exit member 22 in the eductor E for withdrawing the foam concentrate.

The operation of the alternate embodiment of nozzle NC (FIG. 3) is the same as that described above for the operation of nozzle N (FIG. 1).

With the present invention, approximately 7 gallons per minute flows through the eductor means E rather than the full flow of the water through the hose in the prior method using the separate eductor. The separate eductor had a pressure drop of about 30–40% since the fluid pressure was working against a back pressure. With the present invention, there is a relatively insignificant pressure drop in the fluid flowing through the bore 10 of the barrel I, thus providing substantially the full pressure at the nozzle discharge. The discharge of the foam concentrate/liquid mixture into mixing passage 13 which is in a reduced pressure area compared to the pressure in the interior of nozzle N, further assists in providing substantially the full volume and pressure at the discharge of the main stream of water from the nozzle. The present invention eliminates the previously used separate eductor assembly which limited the flow and reduced the pressure of the water from the hose. Since the water flow is relatively unrestricted with the present invention, the range and flow of the nozzles N and NC are greater than the prior apparatus and methods of applying foams such as with the separate eductor or the separate balanced pressure proportioning system.

The single unit reduces the weight of the apparatus which previously included the nozzle, separate eductor and connecting hose or monitor, thus benefiting fire-fighters. With the increased range of the present invention, the fire-fighter operating the nozzle N or NC does not have to approach the fire as closely as was previously required with the prior apparatus and methods.

The foregoing disclosure and description of the invention are illustrative and explanatory thereof, and various changes in the size, shape and materials, as well as in the details of the illustrated construction may be made without departing from the spirit of the invention.

I claim:

1. A nozzle assembly for applying a foam made up from a supply of a foam-forming liquid composition and a flowing liquid stream, comprising:

an inner barrel having an axial bore with an inlet for receiving a liquid stream under pressure and an outlet for discharging the liquid stream therefrom;

flow regulating nozzle means mounted in said outlet for regulating the lateral extent of the stream discharged from the inner barrel;

eductor means with said inner barrel having means for receiving a portion of the liquid flowing through said inner barrel to create a reduced pressure in the eductor means;

foam-forming inlet means mounted with said eductor means for introducing a foam-forming composition into said eductor means as a result of the reduced pressure therein;

a mixing passage between said eductor means and said flow regulating nozzle means; and said eductor means having a discharge opening into said mixing passage in proximity to said outlet of said inner barrel for mixing by an outward deflection with respect to said inner barrel, the foam-forming composition and said portion of said fluid stream flowing through said eductor means, with the remaining liquid stream from the inner barrel prior to discharge from said nozzle assembly, whereby a foam is created, with substantially the full velocity and volume of a liquid stream, to allow the foam to be propelled from the nozzle with a maximum distance of ejection and volume output.

2. The invention of claim 1, wherein said flow regulating nozzle means comprises:

an outer sleeve being movably mounted with the inner barrel for controllably selecting between a position creating a fog-like application and a position forming a straight-stream application.

3. The invention of claim 2, further including:

a locking means mounted with said outer sleeve for retaining said outer sleeve in said selected position.

4. The invention of claim 1, including:

teeth mounted with said flow regulating nozzle means for forming a fog-like application.

5. The invention of claim 2, including:

at least one handle mounted with said outer sleeve.

6. A nozzle assembly for applying a foam made up from a supply of foam-forming liquid composition and a flowing liquid stream, comprising:

an inner barrel having an axial bore with an inlet for receiving a liquid stream under pressure and an outlet for discharging the liquid stream therefrom;

flow regulating nozzle means mounted in said outlet for regulating the lateral extent of the stream discharged from the inner barrel;

eductor means with said inner barrel having means for receiving a portion of the liquid flowing through said inner barrel to create a reduced pressure in the eductor means;

said eductor means further comprising:

a tubular member mounted in the flowing liquid stream having an inlet for receiving a portion of the liquid and an outlet for discharge of the liquid;

a mixing plate mounted substantially perpendicular to the discharge of the liquid from said outlet of said tubular member for radially deflecting the liquid discharge from said tubular member;

foam-forming inlet means mounted with said eductor means for introducing a foam-forming composition into said eductor means as a result of the reduced pressure therein;

said flow regulating nozzle means further comprising:

a deflection plate mounted inwardly and spaced apart of said mixing plate forming a mixing passage therebetween for receiving the foam-forming composition discharge from said outlet of said tubular member, said deflection plate directing the liquid stream from outlet of said inner barrel; and said eductor means having a discharge opening in proximity to said outlet of said inner barrel for mixing the form-forming composition with the liquid stream from the inner barrel in proximity to the discharge of the liquid stream, whereby a foam is created with substantially the full velocity and volume of the liquid stream to obtain maximum distance of projection and volume output of foam from the nozzle.

7. The invention of claim 6 wherein said tubular member includes:

a constricting member for increasing the velocity of said portion of the liquid stream; and an expansion body having a cavity therein to receive said increased velocity portion of the portion of the liquid stream for creating a reduced pressure.

8. The invention of claim 6 wherein said deflector plate includes:

openings forming in said deflection plate for passing a portion of the liquid stream through said deflection plate.

* * * * *

UNITED STATES PATENT AND TRADEMARK OFFICE

CERTIFICATE OF CORRECTION

PATENT NO. : 4,640,461

DATED : Feb. 3, 1987

INVENTOR(S) : Leslie P. Williams

It is certified that error appears in the above-identified patent and that said Letters Patent is hereby corrected as shown below:

On the title page, item [*] Notice:

Please delete "The portion of the term of this patent subsequent to Feb. 5, 2002 has been disclaimed."

Please add - - The portion of the term of this patent subsequent to the expiration of Patent No. 4,497,442 has been disclaimed.- -

Signed and Sealed this

Seventh Day of September, 1999

*Attest:*

Q. TODD DICKINSON

*Attesting Officer*

*Acting Commissioner of Patents and Trademarks*